United States Patent [19]

Matthews

[11] 4,035,134

[45] July 12, 1977

[54] ELECTRONIC VALVE SEAT LEAK DETECTOR

[75] Inventor: Russell Byron Matthews, Goshen, Ind.

[73] Assignee: Johnson Controls, Inc., Milwaukee, Wis.

[21] Appl. No.: 621,670

[22] Filed: Oct. 14, 1975

[51] Int. Cl.[2] ..... F23N 5/24

[52] U.S. Cl. ..... 431/21; 431/22; 137/66

[58] Field of Search ..... 431/142, 143, 145, 146, 431/151, 178, 21, 16, 22; 137/65, 66

[56] References Cited

U.S. PATENT DOCUMENTS

| | | | |
|---|---|---|---|
| 3,273,019 | 9/1966 | Matthews | 431/69 |
| 3,488,131 | 1/1970 | Myers et al. | 431/69 |
| 3,840,322 | 10/1974 | Cade | 431/78 |
| 3,947,220 | 3/1976 | Dietz | 431/71 |

*Primary Examiner*—Edward G. Favors

*Assistant Examiner*—Robert J. Charvat

*Attorney, Agent, or Firm*—Johnson, Dienner, Emrich & Wagner

[57] ABSTRACT

An automatic fuel ignition system which provides automatic detection of a leak condition for a pilot valve which is operable to supply fuel to a pilot burner for ignition to establish pilot flame and a main valve which is operable to supply fuel to a main burner for ignition by the pilot flame of the system including a control circuit operable in response to a request signal to activate the system tentatively, a delay circuit which delays the operation of the pilot valve for a first delay period after the occurrence of the request signal, a flame sensing circuit which senses the presence of the pilot flame and effects operation of the main valve after a second delay period established by the control circuit, the flame sensing circuit being responsive to the presence of a flame at the pilot burner during the first delay period or at the main burner during the second delay period to cause the system to be deactivated.

27 Claims, 3 Drawing Figures

ELECTRONIC VALVE SEAT LEAK DETECTOR

BACKGROUND OF THE INVENTION

1. Field of the Invention

This invention relates to automatic fuel ignition systems, and more particularly, to an automatic fuel ignition system employing electronic leak detection for valves.

2. Description of The Prior Art

Automatic fuel ignition systems include a control circuit which provides sequential operation of valves of the system. For example, in pilot ignition systems, the control circuit responds to a request signal, typically the application of power to the control circuit in response to operation of a thermostatically-controlled switch, to effect the operation of a pilot valve to supply fuel to a pilot outlet. The control circuit also enables an ignition circuit to generate ignition sparks for igniting the fuel to establish a pilot flame. When a pilot flame is established, the control circuit operates a main valve which supplies fuel to a main burner for ignition by the pilot flame.

In such systems, conditions, such as the presence or absence of a flame at the pilot outlet or the main burner, are frequently used to effect the sequencing operations provided by the control circuit and to enable various checks to assure fail-safe operation of the system to prevent inadvertant operation of the valves. Thus, a leak condition for either the pilot valve or the main valve, could interrupt the normal sequencing operations of the system as well as inhibiting certain of the checks which afford fail-safe operation of the system. Morever, in the event either the pilot valve or the main valve is leaking, fuel will be continuously supplied to the pilot outlet of the main burner, wasting fuel and producing a potentially hazardous condition.

In the U.S. Pat. No. 3,840,322 of Philip J. Cade, there is disclosed electrical control circuitry for use in an automatic fuel ignition system and which is operable to effect lock out of the system whenever a flame is provided at a burner apparatus prior to the operation of a fuel valve of the system. Such operation is effected by delaying the energization of the pilot valve for a pre-ignition delay interval after the system is activated. During such time, a lock out switch is energized. If a flame is detected by a flame sensing circuit during the pre-ignition delay, the delay timer is inhibited and the lock out switch continues to be energized and effects irreversible lock out of the system after a predetermined time. Accordingly, it would appear that in the event of a line voltage interruption of a very short duration, wherein the pilot flame may not be extinguished before power is restored, the flame sensing circuit would inhibit the pre-ignition delay timer and permit the system to be locked out. Also, for a loss of flame after the establishment of normal operation, the ignition sequence cannot be reinitiated, and the system proceeds to lock out status. For such conditions, manual reset of the system is required before the system can be reactivated, even though the valves may be functioning properly.

Therefore, it would be desirable to have an automatic fuel ignition system which automatically distinguishes between a leak condition for a pilot valve of the system and a momentary line voltage interruption and which permits recycling of the system following a momentary power loss or a flame out condition, but effects shut down of the system for a leak condition for the valve.

SUMMARY OF THE INVENTION

It is, therefore, an object of the present invention to provide a method and apparatus for electronically detecting a leak condition for a valve.

Another object of the invention is to provide an automatic fuel ignition system including a control arrangement which automatically responds to a leak condition for a fuel valve of the system to effect the shut down of the system in the event of such condition.

Yet another object of the invention is to provide a fail-safe control circuit for use in an automatic fuel ignition system, including a pilot valve and a main valve, which prevents the operation of the main valve in the event of a leak condition for either the pilot valve or the main valve.

Another object of the invention is to provide an automatic fuel ignition system including a control arrangement which permits automatic recycling the system in the event of a momentary line voltage interruption.

These and other objects are achieved by the present invention which has provided a method and a control arrangement for electronically detecting a leak condition for a valve means employed in a control system, such as an automatic fuel ignition system, and for effecting the deactivation of the system for such condition. In accordance with the present invention, a method for causing the deactivation of an automatic fuel ignition system in the event of a leak condition for a valve means of the system, comprises causing the system to be activated tentatively whenever a request signal is provided, delaying the enabling of a pilot valve means of the system for a first time duration after the request signal is provided, sensing for the presence of a pilot flame during said first duration, causing the system to be deactivated whenever a pilot flame is sensed during said first duration, delaying the enabling of a main valve means for a second duration after a pilot flame is established, and maintaining the system activated in the absence of a flame at a main burner apparatus during said second duration.

In accordance with a disclosed embodiment in which the control arrangement is employed in an automatic fuel ignition system for controlling the operation of a pilot valve means and a main valve means, the control arrangement includes control means operable in response to a request signal to effect the operation of the pilot valve means to supply fuel to a pilot burner for ignition to establish a pilot flame, and energizing means operable when enabled to effect the operation of a main valve means to supply fuel to a main burner apparatus. The control means includes delay means for delaying the operation of the pilot valve means for a first time interval, and a flame sensing means operable in the absence of a pilot flame during the first time interval to enable the energizing means when the pilot flame becomes established. The delay means includes means for delaying the operation of the main valve means for a second time interval after the energizing means is enabled. The flame sensing means is operable whenever a flame is established at the main burner apparatus during the second time interval to prevent operation of the main valve means and to effect the deactivation of the system.

For the purpose of effecting the deactivation of the system in the event of a leak condition for one of the valve means of the system, a timeout means is enabled by the delay means after the first time interval for deactivating the system at a predetermined time after the timeout means is energized. A switching means of the energizing means overrides the timeout means to permit the system to be maintained activated for normal operation. In the event the switching means fails to operate within the predetermined time, as in the case of a leak condition for one of the valve means, the timeout means deactivates the system.

Thus, upon activation of the system, the flame sensing means responds to the presence of a flame at the pilot outlet during the first time interval, normally indicative of a leak condition for the pilot valve means, or to the presence of a flame at the main burner during the second time interval, normally indicative of a leak condition for the main valve means, to effect the deactivation of the system by maintaining the timeout means energized. In addition, for a power loss of a short duration, which permits the pilot flame to remain established, the delay interval provided by the delay means assures that the pilot valve means is unoperated during such interval permitting the existing pilot flame to be extinguished before the system is recycled, thereby preventing shut down of the system for such condition.

In the disclosed embodiment, the switching means has an associated energizing circuit means operable when enabled to store energy which is periodically transferred to the switching means under the control of the flame sensing means for operating the switching means. In the absence of a pilot flame, or following a flame out condition, the flame sensing means enables the energizing circuit means to store sufficient energy to operate the switching means. When a pilot flame is established, the flame sensing means causes the energizing circuit means to store an amount of energy which is sufficient to maintain the switching means operated, but which is insufficient to operate the switching means. Thus, whenever a pilot flame is present at the time the system is activated, as, for example, the result of a leak condition for the pilot valve means, the energizing means is prevented from storing sufficient energy for energizing the switching means, and the system is deactivated by the timeout means. However, the control arrangement permits recycling of the system for a momentary power loss or a flame out condition.

Moreover, in the event of a leak condition for the main valve means which causes a flame to be present at the main burner apparatus prior to the energization of the switching means, the flame sensing means prevents the transfer of energy from the energizing circuit means to the switching means, preventing operation of the switching means and permitting the timeout means to deactivate the system.

DESCRIPTION OF PREFERRED EMBODIMENTS

Figure 1:
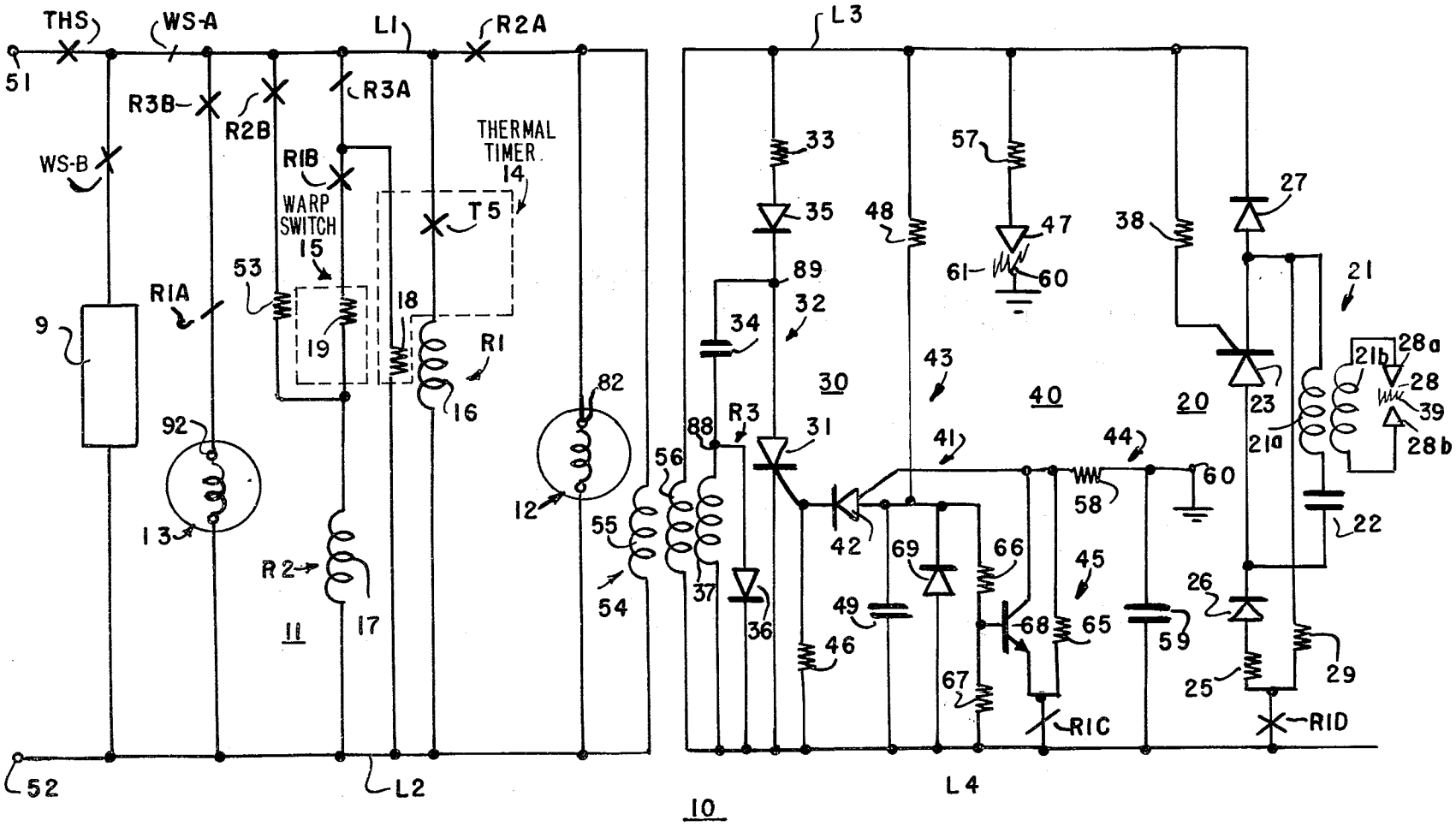
FIG. 1 is a schematic circuit diagram of one embodiment for an automatic fuel ignition system provided by the present invention.

Referring now to FIG. 1, there is shown a schematic circuit diagram for an automatic fuel ignition system 10 provided by the present invention. The fuel ignition system 10 includes a control circuit 11 including control relays R1 and R2 which are energized in response to operation of a thermostatically-controlled switch THS to effect the operation of a pilot valve 12 for supplying fuel to a pilot outlet 71, shown in FIG. 2. Relays R1 and R2 are also used in the control of the operation of a main valve 13, to supply fuel to a main burner apparatus 72 (FIG. 2), and delay the operation of the main valve 13 for a predetermined time after a pilot flame is established during which time a test for a leak condition for the main valve 13 is made. The control circuit 11 also includes a delay timing means, embodied as a thermal timer device 14, which together with relay R1 form a delay means which delays the operation of the pilot valve 12 for predetermined time after the control circuit 11 is energized to enable a check for a leak condition for the pilot valve 12. A time-out device, embodied as a warp switch 15 permits deactivation of the system 10 and the enabling of an alarm device 9 in the event of a malfunction of the system 10, including a leak condition for a pilot valve 12 or the main valve 13.

The fuel ignition system 10 further includes a pilot ignition circuit 20 which is of the capacitor discharge type, having an ignition transformer 21, a capacitor 22, which is periodically charged to predetermined value, and a controlled switching device, embodied as a silicon controlled rectifier 23, operable to discharge the capacitor 22 over the ignition transformer 21 to effect the generation of ignition sparks between ignition electrodes 28, which are located adjacent the pilot outlet 71 (FIG. 2), for igniting fuel supplied to the pilot outlet 71 to establish a pilot flame.

An energizing circuit 30 controls the energization of a relay R3 to effect the operation of the main valve 13 whenever a pilot flame is established to supply gas to the main gas burner apparatus 72 for ignition by the pilot flame. The energizing circuit 30 also maintains the main gas valve 13 operated as long as the pilot flame remains established. The energizing circuit 30 includes a controlled switching device 31, embodied as a silicon controlled rectifier, and a timing network 32, including a resistor 33 and capacitor 34.

The energizing circuit 30 is operable to periodically charge and discharge the capacitor 34 of the timing network 32 under the control of the silicon controlled rectifier 31. The timing network 32, including the capacitor 34, is connected between conductors L3 and L4. Whenever the silicon controlled rectifier 31 is non-conducting, the capacitor 34 is charged by an AC signal provided over conductors L3 and L4. When the silicon controlled rectifier 31 is enabled, the capacitor 34 is discharged through the operate coil 37 of the relay R3. Energy can only be stored by the capacitor 34 if the silicon controlled rectifier 31 is not conducting for a portion of each cycle of the AC signal.

For the purpose of enabling the silicon controlled rectifier 31 to effect the discharge of the capacitor 34, the fuel ignition system 10 further includes a flame sensing circuit 40 which senses the pilot flame and provides enabling pulses for the silicon controlled rectifier 31 during each cycle of the AC signal once the pilot flame is established.

The flame sensing circuit 40 includes a pulse generating circuit 41 comprised of a controlled switching device 42 and associated timing networks 43 and 44 which control the enabling of the controlled switching device 42 such that the controlled switching device 42 normally maintains the silicon controlled rectifier 31 non-conducting whenever the pilot flame is extinguished, to permit the capacitor 34 to charge to a value sufficient to operate relay R3. Relay R3 controls relays R1 and R2 to effect the operation of the main valve 13 after a short delay during which time a check is made for a leak condition for the main valve 13.

The control circuit 40 is operable whenever the pilot flame is established to respond to the AC signal to enable the silicon controlled rectifier 31 at a predetermined time after the start of each cycle of the AC signal. The timing networks 43 and 44 establish the turnon time for the controlled switching device 42 which normally causes the silicon controlled rectifier 31 to be enabled to permit the capacitor 34 to discharge over the relay coil 37 at a time during each cycle after the capacitor 34 has charged to provide discharge current of a value which is sufficient to maintain the relay R3 and thus the main valve 13 operated.

Figure 2:
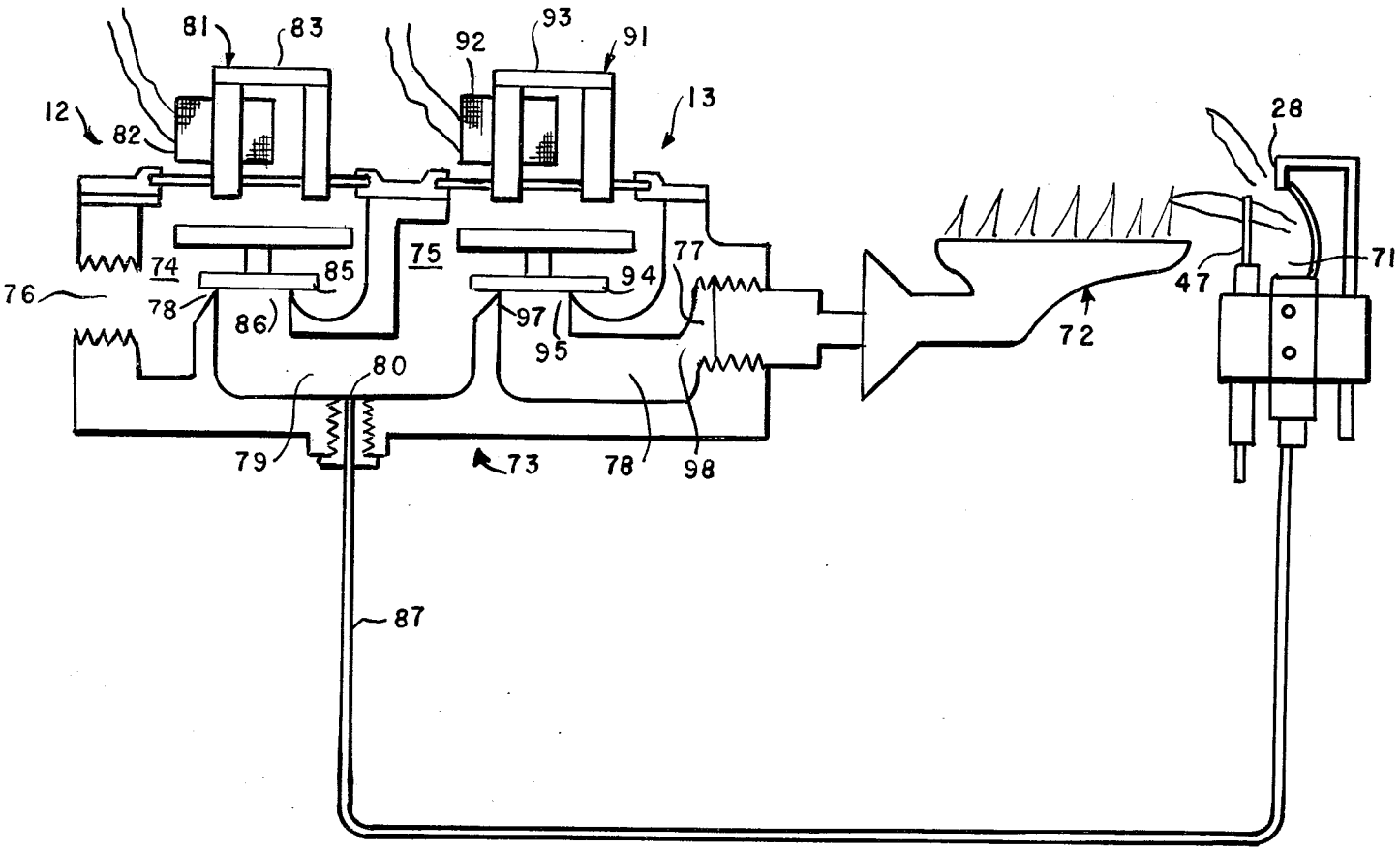
FIG. 2 is simplified representation of a fuel valve and a pilot and main burner apparatus employed in the system shown in FIG. 1; and, FIG. 3 is a schematic circuit diagram of a second embodiment for an automatic fuel ignition system provided by the present invention.

The physical arrangement for the pilot valve 12 and the main valve 13, the main burner apparatus 72 and the pilot burner apparatus 71 is shown in FIG. 2. In the exemplary embodiment, the pilot valve 12 and the main valve 13 comprise a unitary valve structure 73 which, is a simplified representation of a similar valve structure which is disclosed in by copending application Ser. No. 630,168, now U.S. Pat. No. 3,999,932, entitled "VALVE SEAT LEAK DETECTOR." It is pointed out that unitary valve 73 is merely representative of one type of valve that may be used in the system of the present invention, and the pilot valve 12 and the main valve 13 may be separate valves.

The valve 73 is fully disclosed in the referenced application, and accordingly will not be described in detail in the present application. Briefly, the valve 73 comprises a pilot valve section 74 and a main valve section 75 which are connected in a redundant configuration between an inlet 76 and an outlet 77 of the valve 73. Thus, both the pilot valve 12 and the main valve 13 must be operated before fuel is supplied to the outlet 77 of the valve 73. The pilot valve 12 includes solenoid 81, having an operate coil 82 and a core 83, which is operable when energized to lift a valve disc 85 off a valve seat 78 to permit the fuel to flow through a port 86 from the inlet 76 to the central chamber 79. A pilot outlet 80, which communicates with the central chamber 79, permits fuel to flow over a fuel line 87 to the pilot burner apparatus 71.

Thus, whenever the pilot valve 12 is operated, fuel is supplied to the pilot outlet 71 for ignition by sparks produced between the ignition electrodes 28 which are disposed adjacent the pilot outlet 71. A flame sensor probe 47 of the flame sensing circuit 40 is located in the proximity of the pilot outlet 71 for sensing the presence of the pilot flame and controlling the flame sensing circuit 40 to effect the operation of the main valve 13 when a pilot flame is established.

The main valve section 75 of valve 73 includes a further solenoid 91, having a winding 92 and a core 93, which is operable when energized to lift valve disc 94 off a valve seat 97 to permit fuel to flow through a port 95 from the central chamber 79 through a passageway 98 to the main burner apparatus 72 where the fuel is ignited by the pilot flame.

In accordance with the present invention, the automatic fuel ignition system 10 electronically detects a leak condition for the main valve 13 and/or the pilot valve 12 and effects the deactivation of the system 10 whenever a leak condition is detected for one of the valves.

Briefly, in normal operation, that is when both the pilot valve 12 and the main valve 13 are functioning properly, then when the thermostatically-controlled contacts THS close, applying a 24 VAC signal (request signal) to the control circuit 11, the thermal timer 14 (timing means) is energized and after a predetermined time delay (first time interval), effects the operation of relay R1 (second switching means). The operation of relay R1 effects the operation of relay R2 (first switching means) and the energization of the timeout device 15 which then permits the system to be maintained energized for a predetermined time (ignition interval). Relay R1 also interrupts the energizing path for the main valve 13.

When relay R2 operates, the pilot valve 12 is operated to supply fuel to the pilot outlet 71 and the ignition circuit 20 is energized to effect the generation of ignition sparks at electrodes 28 for igniting the fuel supplied to the pilot outlet 71. In addition, the energizing circuit 30 permits the capacitor 34 to charge to a value sufficient to operate relay R3 (third switching means).

When the pilot flame is established, the flame sensing circuit 40 causes the capacitor 34 to discharge over the operate coil 37 of the relay R3, causing the relay R3 to be operated to deenergize the timeout device 15 and the thermal timer 14, and to prepare an energizing path for the main valve 13. However, operation of the main valve 13 is prevented at this time by relay R1. After a predetermined delay (further time interval), established by the cooling time of the thermal timer 14, relay R1 is deenergized permitting the main valve 13 to operate.

For the purpose of detecting a leak through port 86 of the pilot valve 12, the thermal timer 14 is energized when thermostatically-controlled contacts THS close to delay the energization of the pilot valve 12 for a predetermined interval, defined by the heating time of a heater 18 of the thermal timer 14. After such interval, contacts TS close to energize coil 16 and relay R1 operates to energize relay R2 which operates the pilot valve and applies power to the control circuit. Thus, if a flame is established at the pilot outlet 71 during the delay interval, due to leakage of fuel over the pilot valve 12 to the pilot burner 71, which permitted the pilot flame to remain lit when the system was deactivated, then, when relay R2 operates to energize the energizing circuit 30 and the flame sensing circuit 40, the flame sensing circuit 40 responds to the AC signal applied to conductors L3 and L4 to enable the silicon controlled rectifier 31 during each cycle of the AC signal to limit the charge of capacitor 34, and thereby prevent operation of relay R3. Accordingly, after a predetermined time, the warp switch 15 operates associated contacts WS-A to shut down the system 10, and contacts WS-B to energize the alarm device 9.

For the purpose of detecting a leak through port 95 of the main valve 13, relay R1 is operable, when energized, to interrupt the energization path for the main valve 13 over contacts RIA. Relay R1 is controlled by the thermal timer 14 and remains operated as long as the contacts TS of the thermal timer 14 are operated. When the main valve 13 (as well as the pilot valve 12), is functioning properly, relay R3 is operated upon the establishment of a pilot flame, and relay R3 causes deenergization of the thermal timer 14. Relay R1 is maintained energized for predetermined time, established by the cooling time of the thermal timer 14, during which time a leak check is made for the main valve 13. Assuming a pilot flame is established at the pilot outlet 71, then if there is leakage from the main valve 13 to the main burner 72, fuel supplied to the main burner 72 is lit by the pilot flame. The flame sensing circuit 40 includes an oversignal clamping circuit 45 which is disabled at this time by relay R1, so that whenever a large flame is present at the main burner 72 while the oversignal clamping circuit 45 is disabled, the controlled switching device 42 is maintained cutoff, preventing operation of relay R3. Accordingly, the warp switch 15 continues to be energized and after the heating time for warp switch heater 19, contact WS-A operate to shut down the system 10.

In summary, under normal operating conditions, relay R3 is operated once the pilot flame is established, disconnecting the thermal timer 14 from the energizing source and permitting relay R1 to release after the predetermined delay established by the cooling time of the thermal timer 14. The operation of relay R3 also causes deenergization of the warp switch 15 so that the system 10 is maintained activated until contacts THS open. When a leak condition occurs for either the main valve 13 or the pilot valve 12, relay R3 is maintained deenergized and the system is deactivated.

Considering the automatic fuel ignition system in more detail, the system 10 has a pair of input terminals 51 and 52 which are connectable to a 24 VAC source for supplying power to the system 10. Terminal 51 is connected over normally open thermostatically-controlled contacts THS and over normally closed contacts WSA of the warp switch 15 to a conductor L1 and terminal 52 is connected directly to a conductor L2.

The resistance 18 of the thermal timer 14 is connected in series with normally closed contacts R3A of relay R3 between conductors L1 and L2 and is energized whenever contacts THS are operated to close. The thermal timer has normally open contacts TS which are connected in series with the operate winding 16 of relay R1 between conductors L1 and L2 and close to operate relay R1 at a predetermined time after the energization of the heater 18.

The heater 19 of the warp switch 15 and an operate coil 17 of relay R2 are connected in series between conductors L1 and L2 over normally open contacts R1B of relay R1 and normally closed contacts R3A of relay R3 for energization whenever relay R1 is operated and relay R3 is unoperated. A holding path is provided for relay R2 over a resistor 53 and normally open contacts R2B of relay R2.

The operate coil 82 of the pilot valve 12 is connected over normally open contacts R2A of relay R2 between conductors L1 and L2, and is energized whenever contacts R2A are operated to close to operate the pilot valve 12 to supply fuel to the pilot burner 71 for ignition to establish a pilot flame.

The operate coil 92 of the main valve 13 is connected over normally closed contacts R1A of relay R1 and normally open contacts R3B of relay R3 between conductors L1 and L2 and is energized whenever relay R1 is unoperated and relay R3 is operated to operate the main valve 13 to supply fuel to the main burner apparatus 72 for ignition by the pilot flame.

In addition, for the purpose of extending AC power to conductors L3 and L4 to the ignition circuit 20, the energizing circuit 30 and the flame sensing circuit 40, a power transformer 54 has a primary winding 55 having one end connected over normally open contacts R2A of relay R2 to conductor L1 and another end connected directly to conductor L2 to be energized whenever relay R2 operates to close contacts R2B. A secondary winding 56 of the transformer 54 is connected between conductors L3 and L4. The transformer 54 may be a step-up transformer so that upon energization of the primary winding 55 with 24 VAC, a 120 VAC power is supplied to conductors L3 and L4 over the secondary winding 56.

Referring now to the ignition circuit 20, the capacitor 22 is connected in a series charging circuit which extends from conductor L4 over normally open contacts R1D of relay R1, a resistor 25, a diode 26, the capacitor 22, the primary winding 21a of the ignition transformer 21 and a diode 27 to conductor L3. The silicon controlled rectifier 23 is connected in shunt with a primary winding 21a of the ignition transformer 21 and capacitor 22. The gate electrode of the silicon controlled rectifier 23 is connected over a resistor 38 to conductor L3. A resistor 29 is connected from the cathode of the silicon controlled rectifier 23 to contacts R1D to connect the cathode of the silicon controlled rectifier 23 to conductor L4 whenever contacts R1D are closed. The ignition electrodes 28, include a pair of electrodes 28a and 28b which are connected to opposite ends of the secondary winding 21b of the ignition transformer 21, and disposed adjacent the pilot outlet 71 in a spaced relationship, providing a gap 39 there between.

Ignition electrode 28b is connected to a ground reference point, which may, for example, be a metallic ground provided by the pilot burner 71 or the main burner apparatus 72.

In operation, whenever AC power is applied to conductors L3 and L4 in response to the closing of contacts THS and the operation of relays R1 and R2, the capacitor 22 is charged during negative half cycles of the AC signal, that is, when conductor L4 is positive relative to conductor L3, over the charging path between conductors L4 and L3, which is established over contacts R1D, resistor 25, diode 26, capacitor 22, winding 21a and diode 27 when relay R1 operates to close contacts R1D.

During positive half cycles, that is, when conductor L3 is positive relative to conductor L4, the silicon controlled rectifier 23 is rendered conductive in response to current flow from conductor L3 over resistor 38, the gate-cathode circuit of the silicon controlled rectifier 23 and resistor 29 to conductor L4 permitting capacitor 22 to discharge through winding 21a such that the capacitive discharge current causes a voltage pulse to be induced in the secondary winding 21b which is applied to the ignition electrodes 28 generating a spark for igniting the pilot gas supplied to the pilot outlet 71 to establish a pilot flame.

Referring to the flame sensing circuit 40, the controlled switching device 42 is embodied as a programmable unijunction transistor (PUT), such as the type 2N6028, commercially available from Motorola. The timing network 43, including resistor 48 and capacitor 49, serves as an anode control network for the PUT device 42, and the timing network 44, including resistors 57 and 58 and a capacitor 59, serves as a gate control network for the PUT device 42.

The flame sensing circuit 40 further includes a flame sensing electrode 47 connected over resistor 57 to conductor L3. The electrode 47 is positioned in a spaced-relationship with a ground reference point 60 for the fuel ignition system 10, normally providing a high resistance path, virtually an open circuit, between conductor L3 and the reference point 60. The ground reference point 60 may, for example, be a metallic ground provided by a gas burner apparatus 72 or the pilot burner 71. The flame sensing electrode 47 is located in the region in which the pilot flame is to be produced such that the pilot flame will bridge the gap 61 between the electrode 47 and the reference point 60 thereby lowering the resistance of the current path over the electrode 47 between conductor L3 and the reference point 60 whenever the pilot flame is established. The flame sensing electrode 47 and resistor 58 form a portion of the gate control network 44 for the PUT device 42.

The gate control network 44 determines the gate potential for the normally non-conducting PUT device 42. The gate control network 44 includes capacitor 59 which is connected between the reference point 60 and conductor L4. Whenever the pilot flame bridges the gap 61 between the sensing electrode 47 and the reference point 60, the resistance of the charging path for capacitor 59 is reduced and capacitor 59 charges.

The gate control network 44 further includes resistor 58, which is connected between the reference point 60 and the gate electrode of the PUT device 42, and resistor 65, which is connected between the gate electrode of the PUT device 42 and conductor L4 through contacts R1C. Resistors 58 and 65 form a bleeder path for capacitor 59.

In addition, resistors 66 and 67, which are serially connected from the anode electrode of the PUT device 42, to conductor L4. A transistor 68, having its collector-emmiter circuit connected between the gate electrode of the PUT device 42 and conductor L4 (over contacts R1C), and its base connected to the junction of resistors 66 and 67, form an over signal clamping circuit 45 to normally limit the voltage swing at the gate of the PUT device 42 to a predetermined amount. Whenever a relay R1 is operated to open contacts R1C, the over signal clamping circuit 45 is disabled.

The potential at the anode electrode of the PUT device 42 is determined by the anode control network 43. The anode control network 43 includes capacitor 49 which is connected between the anode electrode of the PUT device 42 and conductor L4. The anode control network 43 further includes resistor 48 which is connected between conductor L3 and the anode electrode of the PUT device 42 and thus to one side of capacitor 49. Accordingly, a charging path is provided for capacitor 49 from conductor L3 over resistor 48 and capacitor 49 to conductor L4. A diode 69, which is connected in parallel with capacitor 49 provides a bypass path for capacitor 49 during negative half cycles of the AC signal whenever the PUT device 42 is not rendered conductive to discharge the capacitor 49.

The PUT device 42 is rendered conductive whenever the potential at the anode electrode exceeds the potential at the gate electrode by approximately 0.6 volts as determined by the action of the anode control network 43 and the gate control network 44. For the condition where the pilot flame is not established, the PUT device 42 conducts at a time when capacitor 49 stores low energy. When the pilot flame is established, the PUT device 42 conducts at a time when the capacitor 49 stores a greater amount of energy which is sufficient to render the silicon controlled rectifier 31 conductive.

Whenever the PUT device 42 is rendered conductive, a discharge path is provided for capacitor 49 over the anode-cathode circuit of the PUT device 42 which supplies pulses provided by the flame sensing circuit 40 to the gate electrode of silicon controlled rectifier 31 of the energizing circuit 30. The silicon controlled rectifier 31 may be the type C106A, manufactured by General Electric Co.

With reference to the energizing circuit 30, the timing network 32 includes a diode 35, resistor 33, capacitor 34 and a diode 36, which are connected in series between conductors L3 and L4 forming a series unidirectional charging path for capacitor 34. The operate coil 37 of relay R3 is connected between one side of capacitor 34 at point 88 and conductor L4. The silicon controlled rectifier 31 has its anode connected to the other side of capacitor 34 at point 89 and its cathode connected to conductor L4. The gate electrode of the silicon controlled rectifier 31 is connected to the output of the flame sensing circuit 40 at the cathode of the PUT device 42, and over a resistor 46 to conductor L4.

The silicon controlled rectifier 31 is normally non-conducting and thus enables capacitor 34 to be charged during positive half cycles of the AC signal on conductors L3 and L4. The silicon controlled rectifier 31 is operable when enabled by pulses provided by the flame sensing circuit 40 in response to the pilot flame to provide a shunt path for capacitor 34 and the operate coil 37 of the relay R3, permitting the capacitor 34 to discharge over the coil 37. Typically, the capacitor 34 charges for approximately three cycles of the AC signal before the capacitor 34 is discharged over the operate coil 37 of the relay R3. The capacitor 34 charges to the peak value of the AC signal and thus stores sufficient energy to operate the relay R3.

Relay R3 may comprise an AC relay having a low coil resistance of approximately 800 ohms so that in the capacitor 34 can provide sufficient discharge to effect energization of the relay R3. Relay R3, which is normally de-energized, has normally open contacts R3B which are connected in series with normally closed contacts R1A of relay R1 and the coil 92 of the main valve 13 between conductors L1 and L2, to permit operation of the main valve 13 whenever the system is operating properly. In addition, relay R3 has normally closed contacts R3A connected in series with the energizing paths for the warp switch 15 and the thermal timer 14 to deenergize the warp switch 15 to prevent the system 10 from being locked out, and to deenergize the thermal timer 14 to enable relay R1 to release to permit energization of the main valve 13.

OPERATION

For the purpose of illustrating the operation of the automatic fuel ignition system 10, it is assumed that contacts THS are open so that the control circuit 11 is initially deenergized such that relays R1–R3 are unoperated, and the main valve 13 and the pilot valve 12 are deenergized.

When contacts THS operate, extending the 24 VAC signal to conductors L1 and L2, current flows from conductor L1 over normally closed contacts R3A of relay R3 and the heater 18 of the thermal timer 14 to conductor L2, which heats, and after a predetermined delay, typically 5–10 seconds, operates contacts TS which close providing an energizing circuit for relay R1. When relay R1 operates, contacts R1A open to interrupt the energizing path for the operate coil 92 of the main valve 13, contacts R1B close to energize the warp switch heater 19 and the operate coil 17 of relay R2. In addition contacts R1C open to disable the over signal clamping circuit 45 of the flame sensing circuit 40, and contacts R1D close to prepare an energizing path for the ignition circuit 20.

Relay R2 then operates, causing contacts R2A to close, energizing the operate coil 82 of the pilot valve 12, which opens to supply fuel to the pilot burner 71. Also, contacts R2B close to provide a holding path over resistor 53 for relay R2. When contacts R2A close, the primary winding 55 of supply transformer 54 is energized, supplying power to conductors L3 and L4 to energize the ignition circuit 20 which is operable in the manner described above to effect the generation of ignition sparks between the ignition electrodes 28 for igniting the fuel supplied to the pilot outlet 71 to establish a pilot flame.

Assuming initially that the pilot flame is extinguished, then when conductor L3 begins to swing positive current flows over the charging network 32 from conductor L3 over resistor 33, diode 35, capacitor 34 and diode 36, charging the capacitor 34. Capacitor 49 of timing circuit 43 charges during the positive half cycle of the AC signal, supplying potentials to the anode of the PUT device 42. In the absence of a pilot flame, capacitor 59 remains discharged and the PUT device 42 conducts early in the positive half cycles of the AC signal and before capacitor 49 has charged to a value sufficient to trigger the silicon controlled rectifier 31 into conduction. Thus, the silicon controlled rectifier 31 remains off, permitting capacitor 34 to charge. In normal operation, capacitor 34 is charged to the peak value of the amplitude of the AC signal supplied over conductors L3 and L4.

When the pilot flame is established, then during the next positive half cycle of the AC signal applied between conductors L3 and L4, when conductor L3 swings positive relative to conductor L4, current flows from conductor L3 through resistor 57, over sensing electrode 47 and the pilot flame to the reference point 60, and over capacitor 59 to conductor L4, permitting capacitor 59 to charge. The voltage across capacitor 59, which is connected over resistor 58 to the gate electrode of the PUT device 42, establishes a gate potential for the PUT device 42.

During the same half cycle, capacitor 49 is charged over a path extending from conductor L3 over resistor 48 and capacitor 49 to the conductor L4, establishing a potential at the anode electrode of the PUT device 42.

The values of capacitors 49 and 59 are selected such that some time before the peak of the AC line voltage during the first half cycle of the AC signal, the anode to gate potential of the PUT device 42 exceeds +o.6 volts so that the PUT device 42 is rendered conductive, permitting capacitor 49 to discharge over the PUT device 42. Also, at such time, capacitor 49 is charged to a voltage sufficient to effect the generation of a voltage pulse across the resistor 46 capable of rendering the silicon controlled rectifier 31 conductive. The speed of response of th flame sensing circuit 40 is a function of the value of capacitor 59 and resistor 58 and 65 which form the bleeder path for capacitor 59.

It should be understood that the only time pulses are supplied to the gate of the silicon controlled rectifier 31 is when the voltage at the anode electrode at the PUT device 42 exceeds that of the gate electrode +0.6 volts, and the silicon controlling rectifier 31 is enabled only when the capacitor 49 has charged sufficiently to provide the pulse energy required to render the silicon controlled rectifier 31 conductive.

When the silicon controlled rectifier 31 is rendered conductive, a discharge path is provided for capacitor 34 over the operate coil 37 for relay R3 which then operates to close contacts R1A to prepare an energizing path for the main valve 13 over contacts R1A of relay R1 which are open at such time. In addition, contacts R3A open to deenergize the thermal timer 14 and the warp switch heater 19. Relay R2 remains energized over its holding path over contacts R2B and resistor 53.

It is pointed out, once the pilot flame has been established and bridges the gap between the sensing electrode 47 and the reference point 60, the flame sensing circuit 40 provides enabling pulses to the gate of the silicon controlled rectifier 31 during positive half cycles of the applied AC line signal. Prior to the enabling of the silicon controlled rectifier 31, the capacitor 34 charges to a value, typically 10 volts, which is sufficient to maintain the relay R3 operated when the capacitor 34 is discharged.

During negative half cycles of the AC line signal, when conductor L4 swings positive relative to conductor L3, the silicon controlled rectifier 31 is cut off. However, relay R3 is maintained energized by the energy stored in the relay magnetic field resulting in current flow through "free-wheeling" diode 36 and relay coil 37 as the magnetic field decays.

During the cooling time for the thermal timer 14, a check is made for a leak condition for the main valve 13. When relay R3 operates, relay R1 is maintained energized for the delay period established by the thermal timer 14. Accordingly, contacts R1C remain open so that the over signal clamping circuit 45 is disabled. If the main valve 13 is leaking, fuel is supplied to the main burner 72 and is lit by the pilot flame producing a large flame. Such condition reduces the impedance of the current path over the flame sensing probe 47 causing increased current flow to the gate of the PUT device 42. Accordingly, for the condition where such leakage occurs after the relay R3 has operated but before the end of the delay period established by the thermal timer 14, the PUT device 42 is maintained off, causing relay R3 to release, closing contacts R3A such that the warp switch heater 19 is energized. The thermal timer 14 is also energized keeping contacts TS closed such that relay R1 remains energized. After a predetermined time, the warp switch 15 operates contacts WSA and WSB to deenergize the system and to energize the alarm device 9.

It is apparent that should the main valve 13 be leaking prior to energization of the system 10, then when the pilot flame is established, fuel leaking to the main burner 72 is lit by the pilot flame so that a flame is established at the main burner 72. Accordingly, when relay R1 operates to disable the over signal clamping circuit 45, the large flame at the main burner 72 lowers the resistance of the charging path for capacitor 59. Accordingly, capacitor 59 charges at a faster rate than capacitor 49 such that the anode potential for the PUT device 42 does not exceed the gate potential by 0.6 V, and the PUT device 42 is prevented from conducting. Thus, the silicon controlled rectifier 31 is maintained non-conducting preventing the discharge of capacitor 34 and relay R3 remains deenergized. Thus, the system 10 will be deactivated by operation of the warp switch 15.

Assuming there is no leakage from the main valve 13, the control circuit 40 maintains relay R3 energized, and after the cooling time of the thermal heater 14, contacts TS open, deenergizing relay R1 closing contacts R1A to energize the main valve 13. In addition, contacts R1D operate to inhibit the ignition circuit 20 and contacts R1C close to enable the over signal clamping circuit 45.

When the over signal clamping circuit 45 is enabled, then, as capacitor 49 charges during each positive half cycle of the AC signal, the potential at the base of transistor 68 rises causing transistor 68 to conduct when the base-emitter turn on potential is reached. When transistor 68 conducts, a discharge path is provided for capacitor 59, which discharges. As capacitor 59 discharges, the gate potential for the PUT device 42 decreases until the anode-gate potential is 0.6 volts at which time the PUT device 42 conducts, discharging capacitor 49 causing the silicon controlled rectifier 31 in turn permits capacitor 34 to discharge over the operate coil 37 of relay R3, maintaining relay R3 operated. Thus, the large flame which is present at the main burner 72 does not effect shut down of the system 10.

When the heat demand has been met, contacts THS open deenergizing the system 10, causing the main valve 13 and the pilot valve 12 to drop out, causing relays R2–R3 to be deenergized. When the main valve 13 and the pilot valve 12 drop out, the main burner flame and the pilot burner flame are extinguished. However, if there is a leak in the pilot valve 12, for example, then when the system 10 is deenergized, the pilot flame remains established. Accordingly, the next time the system 10 is activated in response to operation of switch THS, relays R1–R2 operate as described above. However, when the flame sensing circuit 40 is enabled, the presence of the pilot flame enables capacitor 59 to charge, delaying the enabling of the PUT device 42, enabling silicon controlled rectifier 31 to conduct during each cycle of the AC signal, such that capacitor 34 receives insufficient charge to operate relay R3.

As indicated above, whenever a pilot flame is established, the charging of capacitor 59 causes the PUT device 42 to be maintained non-conducting for a longer time to permit capacitor 49 to be charged to a voltage sufficient to trigger the silicon controlled rectifier 31 into conduction. The time constant of timing network 43, that is, resistor 48 and capacitor 49, is chosen so that the PUT device 42 and thus the silicon controlled rectifier 31 are maintained non-conducting for the first ¼ cycle of the AC signal, but are enabled at a time early in the positive half cycle. The time constant of timing network 32 of the energizing circuit 30 is chosen to be shorter than the time constant of timing network 43. Accordingly, since when the silicon controlled rectifier 31 is rendered conductive during each cycle of the AC signal when the pilot flame is established, this limits the charging of capacitor 34 to a low value, such as 10 volts, which voltage provides sufficient discharge current for maintaining the relay R3 operated, but is insufficient to operate the relay R3. Accordingly, under such condition, the relay R3 is prevented from operating, and, the warp switch heater 19 continues to be energized until its contacts WSA operate to deactivate the system 10. Thus, in the event of leak in the pilot valve 12, the main valve 13 is not energized, and the system 10 locked out after the delay provided by the warp switch 15.

In the event of a fast line interruption which is fast enough to cause momentary deenergization of relays R1–R3, the pilot valve 12 and the main valve 13, the delay afforded by the thermal timer 14 before relays R1 and R2 operate to reenergize the pilot valve 12 assures that the pilot flame is extinguished before the system 10 recycles. Thus, the flame sensing circuit 40 is enabled to effect reenergization of relay R3 after the pilot flame is again established.

For a flame out condition, the operation of the flame sensing circuit 40 is the same as described above for the condition where the capacitor 34 has been fully charged before the pilot flame was established. That is, the high impendance path, virtually an open circuit, provided between sensing electrode 47 and the reference point 60 maintains capacitor 59 discharged such that the PUT device 42 is enabled early in the cycle, at a time before capacitor 49 has charged to a value sufficient to effect the enabling of the silicon controlled rectified 31.

Accordingly, capacitor 34 is prevented from discharging, and relay R3 becomes deenergized. When relay R3 releases, contacts R3B open to deenergize the main valve 13, and contacts R3A close to energize the thermal timer 14 and a trial for pilot ignition is initiated as described above.

SECOND EMBODIMENT

Figure 3:
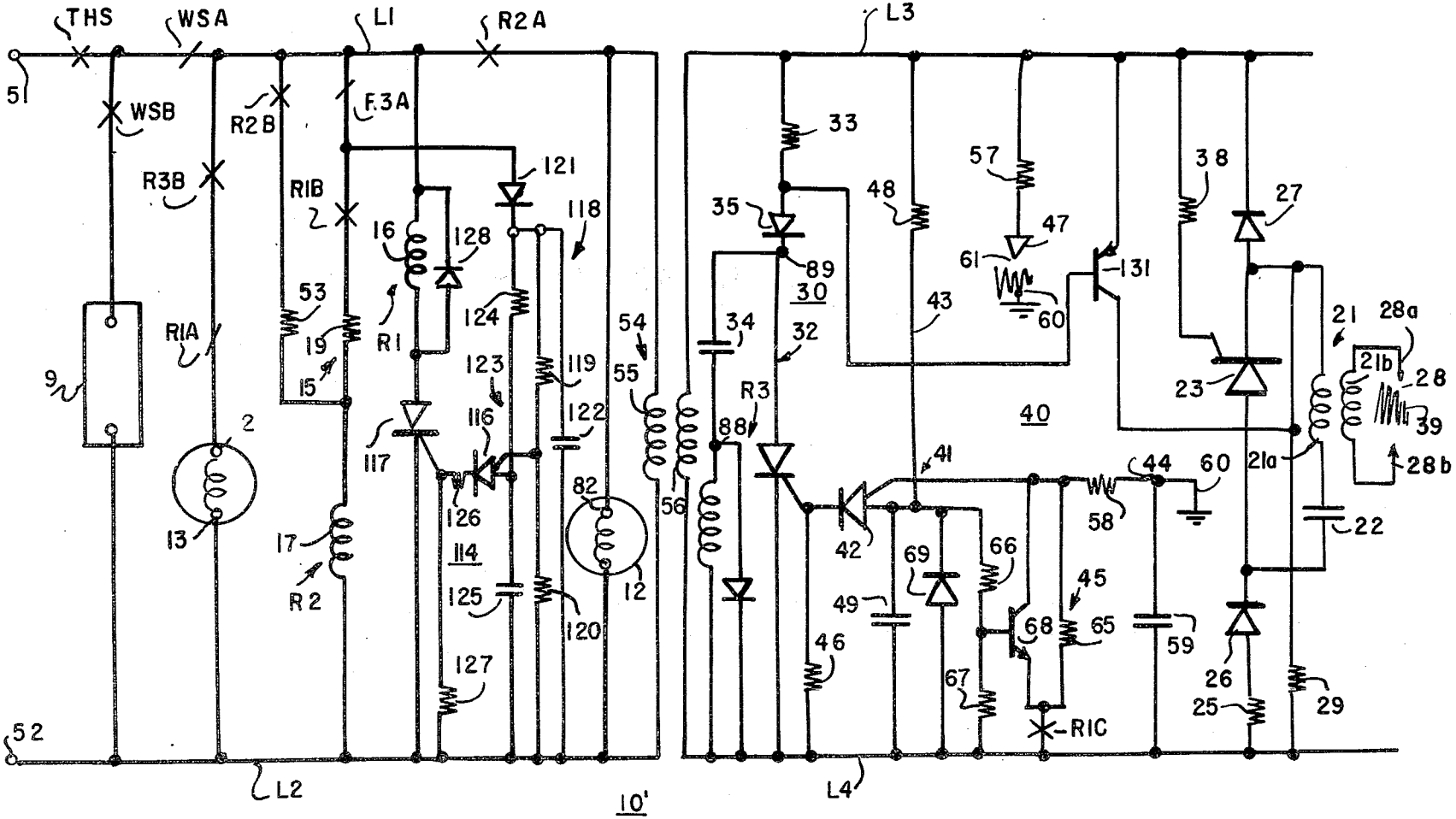

Referring to FIG. 3, there is shown a second embodiment for an automatic fuel ignition system 10' provided by the present invention. The system 10' is generally similar to the system 10 shown in FIG. 1, and includes an ignition circuit 20, an energizing circuit 30, and a flame sensing circuit 40 which are operable in the manner of like circuits employed in the embodiment of FIG. 1, and like components have been given identical reference numbers. The system 10' further includes a control circuit 11' which is connected over terminals 51 and 52 to a 24 VAC source, and including relays R1 and R2 for controlling the operation of the pilot valve 12 and the main valve 13, and a warp switch 15 which permits deactivation of the system 10' and the enabling of an alarm device 9 in the event of a malfunction of the system 10' including a leak condition for the pilot valve 12 or the main valve 13.

In the system 10 shown in FIG. 3, the relay R1 is operated by a pulse generating circuit 114 including a PUT device 116 and silicon controlled rectifier 117 which are operable after a predetermined delay to effect the operation of relay R1 which in turn causes the operation of relay R2 to initiate a trial for ignition of a pilot flame and cause energization of the main valve 13 as described above. The pulse generating circuit 114 thus provides the function of the thermal timer 14 of the system 10.

Considering the pulse generating circuit 114 in detail, the PUT device 116 has a gate control network 118 including resistors 119 and 120 which operate as a voltage divider to establish a potential at the gate of the PUT device 116. Resistors 119 and 120 are connected between conductors L1 and L2 in a series circuit which extends from conductor L1 over normally closed contacts R3A of relay R3, a diode 121, resistor 119 to the gate of the PUT device 116 and resistor 120 to conductor L2. A capacitor 122 is connected in parallel with resistors 119 and 120.

The PUT device 116 has an anode control network 123 including a resistor 124 and a capacitor 125, connected between conductors L1 and L2 to form a unidirectional series charging path for capacitor 125. The charging path extends from conductor L1 over normally closed contacts R3A of relay R3, diode 121, resistor 124 to the anode of the PUT device 116 and over capacitor 125 to conductor L2.

The cathode of the PUT device 116 is connected over a resistor 126 to the gate of the silicon controlled rectifier 117 and over a resistor 127 to conductor L2.

The silicon controlled rectifier 117 has its anodecathode circuit connected in series with the operate coil 16 of relay R1 between conductors L1 and L2 and is operable when enabled to effect energization of the relay R1. A diode 128 is connected in shunt with the operate coil 16 of relay R1.

OPERATION OF THE SECOND EMBODIMENT

Referring to FIG. 3, when contacts THS are operated, extending 24 VAC to conductors L1 and L2, current flows from conductor L2 over normally closed contacts R3A diode 121, and resistors 119 and 120 to conductor L2, establishing a threshold potential at the gate of the PUT device 116. In addition, current flows over the charging path for capacitor 125, from conductor L1, contacts R3A, diode 121, resistor 124 and the capacitor 125 to conductor L2, which causes capacitor 125 to charge. The time constant of resistor 124 and capacitor 125 is selected to provide a delay of approximately 2 seconds before the potential at the anode of the PUT device 116 rises to a value which exceeds the potential at the gate of the PUT device 116 by 0.6 volts. At such time, the PUT device 116 is enabled permitting capacitor 125 to discharge over the PUT device 116, resistor 126, and the gate-cathode circuit of the silicon controlled rectifier 117 to conductor L2, causing the silicon controlled rectifier 117 to conduct so the relay R1 is energized.

When relay R1 operates, the sequence of operations are similar to those described above with reference to FIG. 1, that is, contacts R1A open to interrupt the energizing path for the main valve 13 and contacts R1B close to energize the warp switch heater 19 and the operate coil 17 of relay R2. In addition, contacts R1C closes to disable the over signal clamping circuit 45.

When relay R2 operates, contacts R2A close, energizing the pilot valve coil 82 and the pilot valve operates to supply fuel to the pilot burner 71. In addition, power is supplied over the power transformer 54 to conductors L3, L4 and for energizing the ignition circuit 20, the flame circuit 40 and the energizing circuit 30. In addition, contacts R2B close to provide a holding path for relay R2 over resistor 53.

The ignition circuit 20 operates to generate ignition sparks for igniting fuel supplied to the pilot burner 71. The flame sensing circuit 40 and the energizing circuit 30 are operable in the manner described above the effect energization of relay R3 when the pilot flame is established.

It is pointed out that prior to the operation of relay R3, the pulse generating circuit 114 continues to operate with capacitor 125 being alternately charged over the associated charging path and discharged over the PUT device 116 during each cycle of the AC signal provided on conductors L1 and L2, enabling the silicon controlled rectifier 117 whereby relay R1 remains operated.

When relay R3 operates, contacts R3A open interrupting the charging path for capacitor 125 and for the gate control network 118. As soon as the potential at the anode of the PUT device 116 exceeds the potential at the gate of the PUT device by 0.6 volts, the PUT device 116 conducts, permitting capacitor 125 to discharge over the PUT device 116 maintaining the silicon controlled rectifier 117 in conduction for a predetermined time, which may be 5 seconds and corresponds to the delay provided by the cooling time of the heater 18 of the thermal timer 14 employed in the embodiment shown in FIG. 1. During such time, relay R1 is maintained operated and the over signal clamping circuit 45 is inhibited, and the energizing path for the main valve 13 remains interrupted by contacts R1A of relay R1 which are open, so that the main valve 13 remains unoperated.

Accordingly, if a leak condition for the main valve 13 occurs during this time, a large flame will be present at the main burner 72 causing the flame sensing circuit 40 to be disabled in the manner decribed above with reference to FIG. 1. Thus, relay R3 will be disabled and the system 10′ becomes locked out upon operation of the warp switch 15. It is pointed out that when a leak condition for the main valve 13 occurs prior to operation of relay R3, and a flame is produced at the main burner 72 when the pilot fuel is ignited, the flame sensing circuit 40 is prevented from energizing relay R3 and the system 10′ becomes locked out upon operation of the warp switch 15.

If the main valve 13 is operating properly, then after the 5 second delay provided by the pulse generating circuit 114, the PUT device 116 and the silicon controlled rectifier 117 are disabled, deenergizing relay R1 to effect energization of the main valve 13 which then supplies gas to the burner apparatus 74 for ignition by the pilot flame.

When relay R1 becomes deenergized, contacts R1A close to permit the main valve 13 to operate, supplying fuel to the main burner apparatus 72 for ignition by the pilot flame. In addition, contacts R1B open to interrupt the energizing path for the warp switch heater 19, and contacts R1C close to enable the over signal clamping circuit 45 to prevent the system 10′ from being shut down due to the presence of a flame at the main burner 72.

In the embodiment shown in FIG. 3, an inhibit circuit 130, comprised of a transistor 131 is employed to inhibit the ignition circuit 20 when a pilot flame is established by providing an effective short circuit between the cathode and gate of the silicon controlled rectifier 23 of the ignition circuit 20. Transistor 131 has its collector connected to the cathode of the silicon controlled rectifier 23 and its emitter connected to conductor L3, the gate of the silicon controlled rectifier 23 being connected over resistor 38 to conductor L3. The base of transistor 131 is connected over resistor 33 of the energizing circuit 30 to conductor L3. When a flame is established at the pilot burner 71, the flame sensing circuit 40 enables capacitor 34 to charge during each positive half cycle of the AC signal. The voltage drop across resistor 33 produced by the charging current enables ransistor 131 to conduct, shorts the cathode to gate and disables the silicon controlled rectifier 23 of the ignition circuit 20 during each positive half cycle, thereby preventing the discharge of capacitor 22 inhibitin spark generation. Alternatively, contacts of relay R1 could also be used to inhibit the ignition circuit 20 in the manner described with reference to the embodiment shown in FIG. 1.

For a leak through the pilot valve which enables the pilot flame to burn after the system 10' is deactivated, then the next time the system 10' is activated in response to the operation of contacts THS, the presence of the pilot flame will cause the PUT device 42 of the flame sensing circuit 40 to be enabled during each cycle of the AC signal preventing capacitor 34 from acquiring sufficient charge to operate relay R3. Accordingly, the warp switch 15 will shut down the system 10'.

In the event of a fast line interruption which is fast enough to cause momentary deenergization of relays R1–R3, the pilot valve 12 and the main valve 13, the delay afforded by the pulse generating circuit 114 before relays R1 and R2 operate to reenergize the pilot valve 12 assures that the pilot flame is extinguished before the system 10' recycles. Thus, the flame sensing circuit 40 is enabled to effect reenergization of relays R3 after the pilot flame is again established.

I claim:

1. In an automatic fuel ignition system including pilot valve means operable when energized to supply fuel to a pilot outlet for ignition to provide a pilot flame at said pilot outlet, main valve means operable when energized to supply fuel to a burner apparatus for ignition by the pilot flame to provide a flame at said burner apparatus, a control arrangement comprising timeout means operable when energized to effect the deactivation of the system at a predetermined time after said timeout means is energized, delay means enabled in response to a request signal which activates the system to effect the energization of said pilot valve means and said timeout means, said delay means delaying the energization of said pilot valve means and said timeout means for a first time interval following the activation of the system, actuator means operable when enabled to effect the energization of said main valve means and to cause said delay means to deenergize said timeout means, and flame sensing means operable in the absence of a flame at said pilot outlet during said first time interval to enable said actuator means when a flame thereafter becomes established at said pilot outlet, said delay means being responsive to said actuator means to delay the energization of said main valve means for a further time interval after a pilot flame is established, and said flame sensing means being operable to disable said actuator means in the event a flame is provided at said burner apparatus during said further time interval to thereby prevent the energization of said main valve means and to permit said delay means to be enabled to energize said timeout means to effect the deactivation of the system.

2. A system as set forth in claim 1 wherein said flame sensing means is operable to maintain said actuator means disabled whenever a flame is provided at said pilot outlet during said first time interval to thereby permit said timeout means to deactivate the system after said predetermined time.

3. A system as set forth in claim 1 which includes first switching means operable when energized to effect the energization of said pilot valve means, said delay means being operable when enabled to delay the energization of said first switching means for said first time interval.

4. A system as set forth in claim 3 wherein said delay means includes second switching means operable to effect energization of said first switching means, and timing means responsive to said request signal for controlling said second switching means to delay the energization of said first switching means for said first time interval.

5. A system as set forth in claim 4 wherein said timing means comprises thermal switching means operable when energized to effect operation of said second switching means after said first time interval, said thermal switching means maintaining said second switching means energized for a further time interval after said thermal switching means is deenergized.

6. A system as set forth in claim 4 wherein said timing means includes pulse generating means operable when enabled to effect the generation of pulses after said first time interval for effecting operation of said second switching means, said pulse generating means including circuit means for maintaining said second switching means energized for a further time interval after said pulse generating means is disabled.

7. In an automatic fuel ignition system including pilot valve means operable when energized to supply fuel to a pilot outlet for ignition to provide a pilot flame, and main valve means operable when energized to supply fuel to a burner apparatus for ignition by the pilot flame, a control arrangement comprising timeout means operable when energized to effect the deactivation of the system after a predetermined time after said timeout means is energized, first switching means operable when enabled to effect the energization of said pilot valve means, delay means including second switching means operable when enabled to effect the energization of said first switching means and said timeout means, and timing means enabled in response to a request signal which activates the system for controlling said second switching means to delay the energization of said first switching means and said timeout means for a first time interval and to thereafter effect the energization of said first switching means and said timeout means, ignition means energized in response to the operation of said second switching means to effect the generation of ignition sparks for igniting fuel supplied to said pilot outlet, actuator means operable when enabled to effect the energization of said main valve means and to disable said delay means to deenergize said timeout means, and flame sensing means operable in the absence of a flame at said pilot outlet during said first time interval to enable said actuator means when a flame is thereafter established at said pilot outlet, and said flame sensing means causing said actuator means to be disabled in the event the flame becomes extinguished to thereby cause said main valve means to be deenergized while said pilot valve means remains energized, and to cause said delay means to reenergize said timeout means to effect the deactivation of the system if a pilot flame fails to be reestablished at the pilot outlet within said predetermined time.

8. In an automatic fuel ignition system including pilot valve means operable when energized to supply fuel to a pilot outlet for ignition to provide a pilot flame, and main valve means operable when energized to supply fuel to a burner apparatus for ignition by the pilot flame, a control arrangement comprising timeout means operable when energized to effect the deactivation of the system at a predetermined time after the timeout means is energized, first switching means operable when enabled to effect the energization of said pilot vave means, delay means including second switching means operable when enabled to effect the energization of said first switching means and said timeout means, and timing means enabled in response to a request signal which activates the system for controlling said second switching means to delay the energization of said first switching means and said timeout means for a first time interval and to thereafter effect the energization of said first switching means and said timeout means, actuator means including third switching means and circuit means for enabling said third switching means to prepare an energizing path for said main valve means to disable said delay means to deenergize said timeout means, said flame sensing means operable in the absence of a flame at said pilot outlet during said first time interval to permit said circuit means to enable said third switching means when a flame is thereafter established at said pilot outlet, and said flame sensing means causing said circuit means to disable said third switching means in the event the flame becomes extinguished to thereby cause said main valve means to deenergized while said pilot valve means remains energized, and to cause said delay means to reenergize said timeout means to effect the deactivation of the system if a pilot flame fails to be reestablished at said pilot outlet within said predetermined time.

9. A system as set forth in claim 8 wherein said second switching means is operable when energized to interrupt the energizing path for said main valve means and wherein said third switching means is operable when energized to disable said delay means thereby causing said second switching means to be deenergized after a predetermined delay to permit energization of said main valve means.

10. A system as set forth in claim 8 which includes alarm means, said timeout means being operable to enable said alarm means upon deactivation of the system by said timeout means.

11. A system as set forth in claim 10 wherein said timeout means comprises a warp switch.

12. A fuel ignition system including pilot valve means operable when energized to supply fuel to a pilot outlet for ignition to provide a pilot flame at said pilot outlet, and main valve means operable when energized to supply fuel to a burner apparatus for ignition by said pilot flame, a control arrangement comprising control means responsive to a request signal to effect the energization of said pilot valve means to permit a pilot flame to be provided at said pilot outlet, energizing means operable when enabled to effect the operation of said main valve means, and flame sensing means enabled by said control means to be operable when a pilot flame is thereafter provided at said pilot outlet to enable said energizing means, said control means including delay means controlled by said energizing means to delay the operation of said main valve means for a predetermined time after a pilot flame is provided and said energizing means is enabled, and said flame sensing means being operable to disable said energizing means, preventing operation of said main valve means, whenever a flame is provided at said burner apparatus during said predetermined time.

13. A system as set forth in claim 12 wherein said flame sensing means is operable to prevent the enabling of said energizing means whenever a flame is established at said pilot outlet at the time said flame sensing means is enabled by said control means.

14. A system as set forth in claim 12 wherein said control means includes first switching means responsive to said delay means to extend an AC energizing signal to said flame sensing means and to said enrergizing means.

15. A system as set forth in claim 14 wherein said delay means comprises second switching means operable when energized to energize said first switching means and timing means energized upon the activation of the system to effect the energization of said second switching means after said predetermined delay.

16. A system as set forth in claim 15 wherein said second switching means is operable when energized to interrupt the energizing path for said main valve means, and wherein said energizing means includes third switching means operable when enabled to deenergize said timing switching means to cause said second switching means to be deenergized, and to prepare an energizing path for said main valve means to permit said main valve means to be energized when said second switching means is deenergized, said timing switching means maintaining said second switching means energized for a given delay time after said timing switching means is deenergized to thereby delay the operation of said main valve means for said given delay time.

17. A fuel ignition system including pilot valve means operable when enabled to supply fuel to a pilot outlet for ignition to provide a pilot flame at said pilot outlet, and main valve means operable when energized to supply fuel to a burner apparatus for ignition by said pilot flame, a control arrangement comprising control means responsive to a request signal to enable said pilot valve means, energizing means operable when enabled to effect the operation of said main valve means, said energizing means including switching means and circuit means including resistance means and capacitance means responsive to an AC signal to permit said capacitance means to charge to a predetermined value, and a controlled switching device operable when enabled to permit said capacitance means to discharge over said switching means to operate said switching means, and flame sensing means enabled by said control means to be responsive to said pilot flame for controlling said energizing means, said flame sensing means including pulse generating means having timing circuit means responsive to said AC signal and operable to cause said controlled switching device to be maintained disabled until a pilot flame is established, and operable when the pilot flame is established to enable said controlled switching device to permit said capacitance means to discharge over said switching means to operate said switching means, said control means including delay means responsive to said switching means to delay the operation of said main valve means for a predetermined time after said energizing means is enabled, and said flame sensing means being operable to disable said energizing means whenever a flame is established at said burner apparatus during said predetermined time.

18. A system as set forth in claim 17 wherein said pulse generating means is operable whenever a pilot flame is established at the time the flame sensing means is energized to maintain said controlled switching device disabled to thereby maintain said switching means deenergized.

19. A system as set forth in claim 17 wherein said pulse generating means is operable to cause said switching means to be disabled whenever a flame is present at said burner apparatus before the end of the predetermined time.

20. A system as set forth in claim 19 wherein said flame sensing means further includes oversignal clamping means disabled by said delay means whenever said delay means is operated, said oversignal clamping means being enabled whenever said delay means is disabled to control said pulse generating means for enabling said controlled switching device to maintain said switching means operated.

21. A system as set forth in claim 13 wherein said delay means includes timing means operable when energized to delay the energization of said pilot valve means for a time interval whereby upon momentary deactivation of the system, while a pilot flame is established, the supply of fuel to said pilot outlet is interrupted for said time interval in the absence of a leak condition for said pilot valve means, causing the pilot flame to be extinguished before said flame sensing means is enabled.

22. In an automatic fuel ignition system including pilot valve means operable when energized to supply fuel to a pilot burner apparatus for ignition to establish a pilot flame at said pilot burner apparatus, and main valve means operable when energized to supply fuel to a main burner apparatus for ignition by the pilot flame, a control arrangement for controlling the operation of said pilot valve means and said main valve means comprising control means operable in response to a request signal to effect the operation of said pilot valve means, said control means including delay means for delaying the operation of said pilot valve means for a first time interval, energizing means operable when enabled to effect the operation of said main valve means, flame sensing means operable when enabled to be responsive to said pilot flame for enabling said energizing means, said delay means being responsive to said energizing means for delaying the operation of said main valve means for a second time interval after a pilot flame is established and said energizing means is enabled, and said flame sensing means being operable whenever a flame is established at said main burner apparatus during said second time interval, indicative of a leak condition for said main valve means, to effect the deactivation of the system.

23. A system as set forth in claim 22 wherein said flame sensing means is operable to effect the deactivation of the system whenever a pilot flame is established at said pilot burner apparatus during said first time interval, indicative of a leak condition for said pilot valve means.

24. In an automatic fuel ignition system including pilot valve means operable when energized during an ignition cycle to supply fuel to a pilot outlet to establish a pilot flame, and main valve means operable when energized to supply fuel to a burner apparatus for ignition by the pilot flame, a control arrangement comprising actuator means operable when enabled to effect the energization of said main valve means, flame sensing means operable in the absence of a pilot flame at said pilot outlet for a predetermined time interval prior to the start of an ignition cycle to enable said actuator means when a flame is thereafter established at said pilot outlet, and said flame sensing means being operable whenever a flame is provided at said pilot outlet during said time interval to maintain said actuator means disabled thereby preventing energization of said main valve means, and delay means enabled following the deactivation of the system for a short duration, in which said pilot valve means is deenergized and said pilot flame remains established, to delay the reenergization of said pilot valve means for a delay interval prior to the start of a further ignition cycle to permit the pilot flame to be extinguished for a time before the start of said further ignition cycle.

25. In an automatic fuel ignition system including pilot valve means operable when energized to supply fuel to a fuel outlet for ignition to establish a pilot flame at said outlet, and main valve means energized when a pilot flame is established to supply fuel to a burner apparatus for ignition by the pilot flame, a method for causing the system to be deactivated in the event of a leak condition for either one of said valve means, said method comprising causing the system to be activated tentatively whenever said request signal is provided, delaying the enabling of said pilot valve means for a first duration after said request signal is provided, sensing for the presence of a pilot flame established at said fuel outlet during said first duration, causing the system to be deactivated whenever a pilot flame is sensed at said fuel outlet at the end of said first duration, delaying the enabling of said main valve means for a second duration after a pilot flame is established, and maintaining the system activated after said second duration in the absence of a flame at said burner apparatus during said second duration.

26. In an automatic fuel ignition system having valve means including a pilot valve operable when energized to supply fuel to a pilot burner for ignition to establish a pilot flame, a main valve operable when energized to supply fuel to a main burner for ignition by the pilot flame, and control means responsive to a request signal for effecting the energization of said pilot valve and said main valve, a method for causing the system to be deactivated in the event of a leak condition for said valve means, said method comprising causing the system to be activated tentatively whenever said request signal is provided, energizing said pilot valve at a first predetermined time to supply fuel to said pilot outlet for ignition to establish a pilot flame, sensing for the presence of a pilot flame, enabling the control means to energize said main valve at a second predetermined time after a pilot flame is sensed, sensing for the presence of a flame at said main burner, and enabling said control means to prevent the operation of said main valve and to deactivate the system whenever a flame is sensed at said main burner before said second predetermined time.

27. A method as set forth in claim 26 which includes enabling said control means to deactivate the system whenever a pilot flame is sensed at said pilot burner at said first predetermined time.

* * * * *